US011604009B2

(12) United States Patent
Hollister et al.

(10) Patent No.: US 11,604,009 B2
(45) Date of Patent: Mar. 14, 2023

(54) COOLING SYSTEM

(71) Applicant: Heatcraft Refrigeration Products LLC, Stone Mountain, GA (US)

(72) Inventors: Michael Hollister, Atlanta, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 172 days.

(21) Appl. No.: 17/229,552

(22) Filed: Apr. 13, 2021

(65) Prior Publication Data

US 2021/0231356 A1 Jul. 29, 2021

Related U.S. Application Data

(63) Continuation of application No. 16/460,585, filed on Jul. 2, 2019, now Pat. No. 11,035,599.

(51) Int. Cl.
*F25B 1/10* (2006.01)
*F25B 47/02* (2006.01)

(52) U.S. Cl.
CPC ..... *F25B 1/10* (2013.01); *F25B 47/02* (2013.01); *F25B 2341/06* (2013.01); *F25B 2400/19* (2013.01); *F25B 2700/11* (2013.01)

(58) Field of Classification Search
CPC ..... F25B 1/10; F25B 47/02; F25B 47/022; F25B 2341/06; F25B 2400/19; F25B 2700/11; F25B 5/02
See application file for complete search history.

(56) References Cited

U.S. PATENT DOCUMENTS

| | | | | |
|---|---|---|---|---|
| 3,234,753 | A | 2/1966 | Quick | |
| 2012/0285185 | A1 | 11/2012 | Huff | |
| 2013/0298593 | A1 | 11/2013 | Christensen | |
| 2014/0151015 | A1 | 6/2014 | Sun et al. | |
| 2015/0345835 | A1* | 12/2015 | Martin | F25B 15/06 62/238.3 |
| 2018/0252441 | A1 | 9/2018 | Zha et al. | |
| 2021/0003331 | A1 | 1/2021 | Hollister et al. | |

FOREIGN PATENT DOCUMENTS

| | | | |
|---|---|---|---|
| DE | 102017110560 | A1 | 11/2018 |
| WO | 2013078088 | A1 | 5/2013 |
| WO | 2014179442 | A1 | 11/2014 |

OTHER PUBLICATIONS

European Patent Office, the extended European Search Report, Application No. 20183035.3, dated Dec. 1, 2020, 9 pages.

* cited by examiner

*Primary Examiner* — Emmanuel E Duke
(74) *Attorney, Agent, or Firm* — Baker Botts L.L.P.

(57) ABSTRACT

An apparatus includes a flash tank that stores a refrigerant, a first load that uses the refrigerant to cool a first space, second and third loads, first and second compressors, and a high side heat exchanger configured to remove heat from the refrigerant. During a first mode of operation: the second load uses the refrigerant to cool a second space, the third load uses the refrigerant to cool a third space, the second compressor compresses the refrigerant from the second and third loads, and the first compressor compresses the refrigerant from the first load and the second compressor. During a second mode of operation, the second compressor compresses the refrigerant from the second load and directs the compressed refrigerant to the third load to defrost the third load.

20 Claims, 3 Drawing Sheets

COOLING SYSTEM

CROSS-REFERENCE TO RELATED APPLICATIONS

This application is a continuation of U.S. patent application Ser. No. 16/460,585 filed Jul. 2, 2019, by Michael Hollister et al., and entitled "COOLING SYSTEM," which is incorporated herein by reference.

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

One way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. In conventional systems, the hot gas travels very quickly over/through the loads. As a result, heat transfer between the hot gas and the load is limited, which causes the hot gas defrost process to use more hot gas to defrost the load.

This disclosure contemplates an unconventional cooling system that improves heat transfer between the hot gas and the load by increasing the pressure of the hot gas at the load. The system uses a valve (e.g., a regulating valve) that prevents the hot gas at the load from flowing to a receiver (e.g., a flash tank) until a pressure of the hot gas at the load exceeds a threshold. By increasing the pressure of the gas at the load, the hot gas lingers longer in the load, which increases the heat transfer between the hot gas and the load. In some instances, the hot gas even condenses at the load. In this manner, less hot gas (i.e., a decreased mass flow of hot gas) is used to defrost a load. Certain embodiments of the cooling system are described below.

According to an embodiment, an apparatus includes a high side heat exchanger that removes heat from a refrigerant, a flash tank that stores the refrigerant, a first load that uses the refrigerant from the flash tank to cool a first space proximate the first load, a second load, a third load, a first compressor, a second compressor, and a valve. During a first mode of operation: the second load uses the refrigerant from the flash tank to cool a second space proximate the second load, the third load uses the refrigerant from the flash tank to cool a third space proximate the third load, the second compressor compresses the refrigerant from the second load and the third load, and the first compressor compresses the refrigerant from the first load and the second compressor. During a second mode of operation: the second compressor compresses the refrigerant from the second load and directs the compressed refrigerant to the third load to defrost the third load and the valve prevents the refrigerant at the third load from flowing to the flash tank until a pressure of the refrigerant at the third load exceeds a threshold.

According to another embodiment, a method includes removing, by a high side heat exchanger, heat from a refrigerant, storing, by a flash tank, the refrigerant, and using, by a first load, the refrigerant from the flash tank to cool a first space proximate the first load. The method also includes during a first mode of operation: using, by a second load, refrigerant from the flash tank to cool a second space proximate the second load, using, by a third load, the refrigerant from the flash tank to cool a third space proximate the third load, compressing, by a second compressor, the refrigerant from the second load and the third load, and compressing, by a first compressor, the refrigerant from the first load and the second compressor. The method further includes during a second mode of operation: compressing, by the second compressor, the refrigerant from the second load, directing, by the second compressor, the compressed refrigerant to the third load to defrost the third load, and preventing, by a valve, the refrigerant at the third load from flowing to the flash tank until a pressure of the refrigerant at the third load exceeds a threshold.

According to yet another embodiment, a system includes a flash tank that stores a refrigerant, a first load that uses the refrigerant from the flash tank to cool a first space proximate the first load, a second load, a third load, a first compressor, a second compressor, and a valve. During a first mode of operation: the second load uses the refrigerant from the flash tank to cool a second space proximate the second load, the third load uses the refrigerant from the flash tank to cool a third space proximate the third load, the second compressor compresses the refrigerant from the second load and the third load, and the first compressor compresses the refrigerant from the first load and the second compressor. During a second mode of operation: the second compressor compresses the refrigerant from the second load and directs the compressed refrigerant to the third load to defrost the third load and the valve prevents the refrigerant at the third load from flowing to the flash tank until a pressure of the refrigerant at the third load exceeds a threshold.

Certain embodiments provide one or more technical advantages. For example, an embodiment increases the heat transfer between hot gas and a load during a defrost cycle by increasing a pressure of the hot gas at the load. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
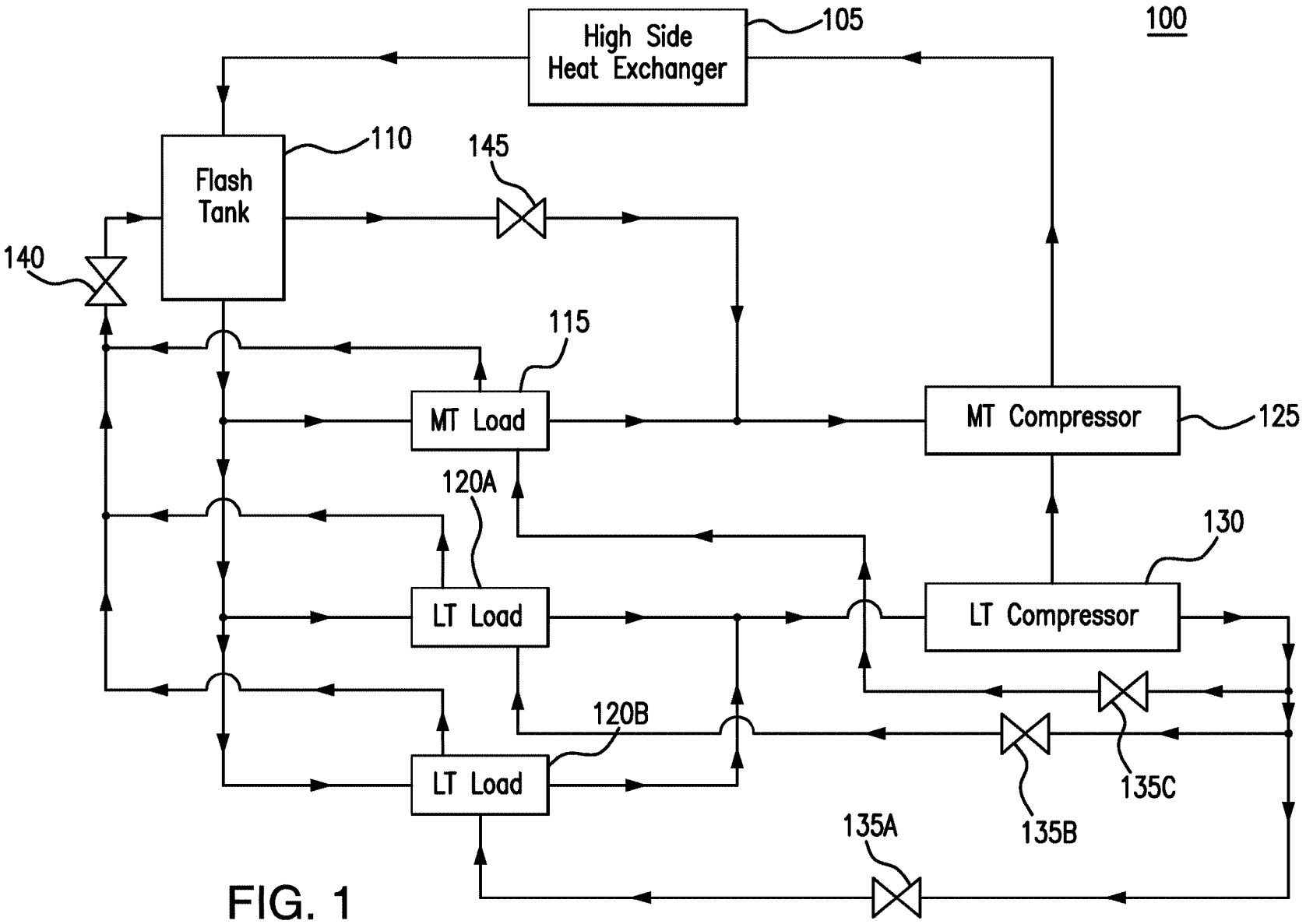
FIG. 1 illustrates an example cooling system.
Figure 2:
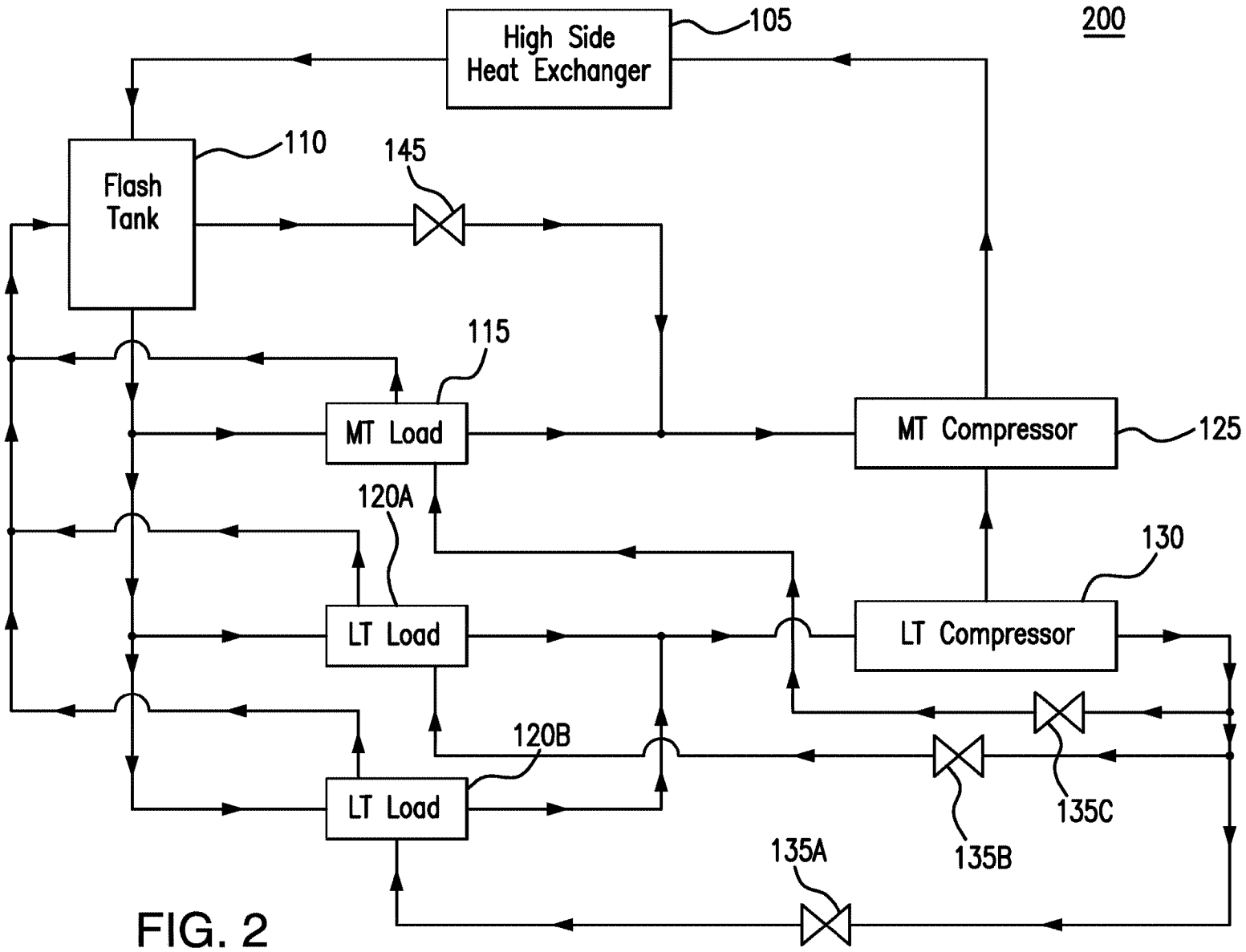
FIG. 2 illustrates an example cooling system.
Figure 3:
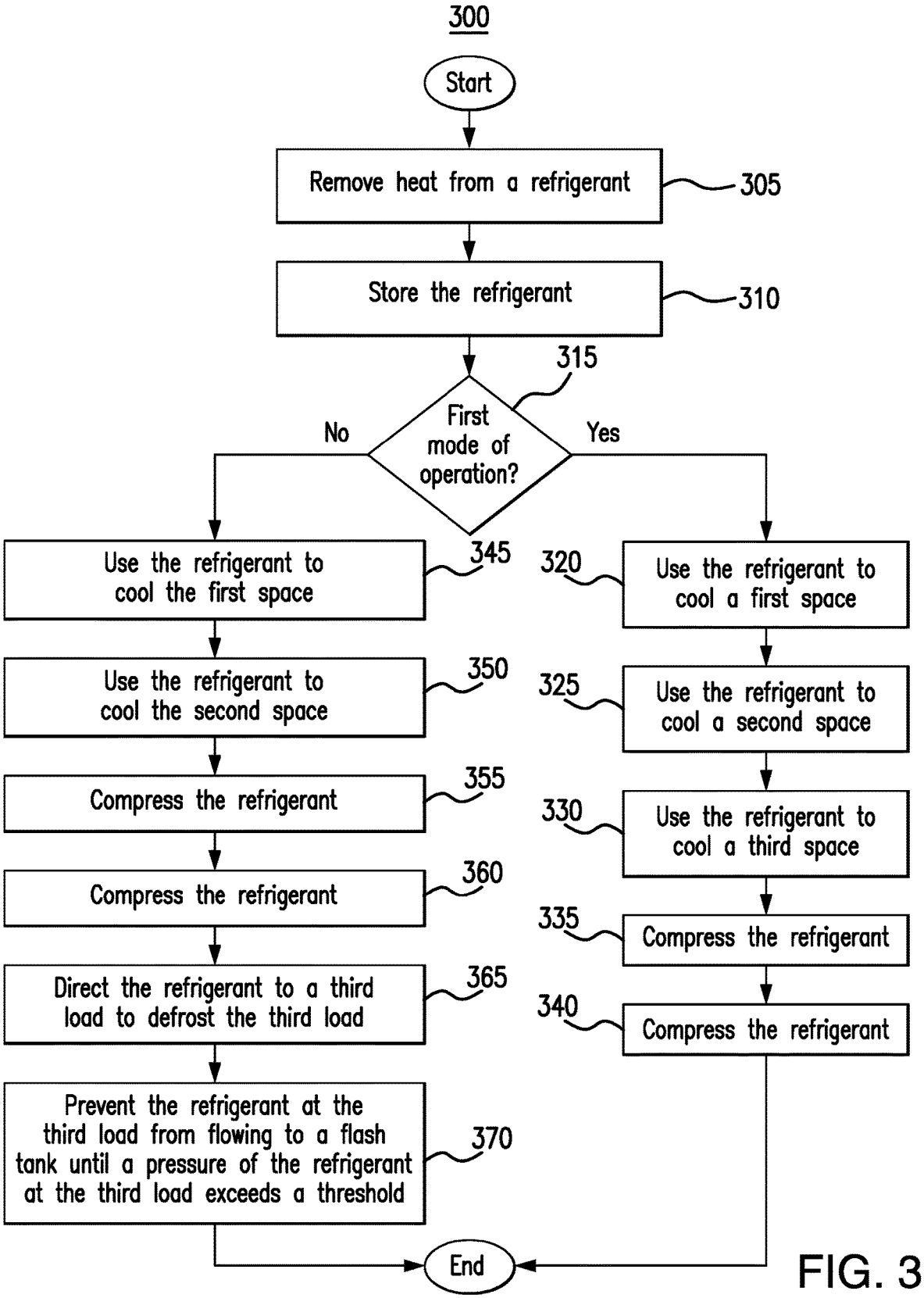
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

One way to address frost and/or ice accumulation on the load is to cycle refrigerant back to the load after the refrigerant has absorbed heat from the load. Usually, discharge from a low temperature compressor is cycled back to a load to defrost that load. In this manner, the heated refrigerant passes over the frost and/or ice accumulation and defrosts the load. This process of cycling hot refrigerant over frosted and/or iced loads is known as hot gas defrost. In conventional systems, the hot gas travels very quickly over/through the loads. As a result, heat transfer between the hot gas and the load is limited, which causes the hot gas defrost process to use more hot gas to defrost the load.

This disclosure contemplates an unconventional cooling system that improves heat transfer between the hot gas and the load by increasing the pressure of the hot gas at the load. The system uses a valve (e.g., a regulating valve) that prevents the hot gas at the load from flowing to a receiver (e.g., a flash tank) until a pressure of the hot gas at the load exceeds a threshold. By increasing the pressure of the gas at the load, the hot gas lingers longer in the load, which increases the heat transfer between the hot gas and the load. In some instances, the hot gas even condenses at the load. In this manner, less hot gas (i.e., a decreased mass flow of hot gas) is used to defrost a load. The cooling system will be described using FIGS. 1 through 3.

FIG. 1 illustrates an example cooling system 100. As shown in FIG. 1, system 100 includes a high side heat exchanger 105, a flash tank 110, a medium temperature load 115, low temperature loads 120A and 120B, a medium temperature compressor 125, a low temperature compressor 130, a valves 135A-C, a valve 140, and a valve 145. Generally, valve 140 prevents hot gas at a low temperature load 120 from flowing to flash tank 110 until a pressure of the gas at the low temperature load 120 exceeds a threshold. This disclosure contemplates cooling system 100 or any cooling system described herein including any number of loads, whether low temperature or medium temperature.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature loads 120A and 120B and medium temperature load 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature loads 120A and 120B and medium temperature load 115. When the refrigerant reaches low temperature loads 120A and 120B or medium temperature load 115, the refrigerant removes heat from the air around low temperature loads 120A and 120B or medium temperature load 115. As a result, the air is cooled. The cooled air may then be circulated such as, for example, by a fan to cool a space such as, for example, a freezer and/or a refrigerated shelf. As refrigerant passes through low temperature loads 120A and 120B and medium temperature load 115, the refrigerant may change from a liquid state to a gaseous state as it absorbs heat. This disclosure contemplates including any number of low temperature loads 120 and medium temperature loads 115 in any of the disclosed cooling systems.

The refrigerant cools metallic components of low temperature loads 120A and 120B and medium temperature load 115 as the refrigerant passes through low temperature loads 120A and 120B and medium temperature load 115. For example, metallic coils, plates, parts of low temperature loads 120A and 120B and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant flows from low temperature loads 120A and 120B and medium temperature load 115 to compressors 125 and 130. This disclosure contemplates the disclosed cooling systems including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature loads 120A and 120B and sends the compressed refrigerant to medium temperature compressor 125. Medium temperature compressor 125 compresses a mixture of the refrigerant from low temperature compressor 130 and medium temperature load 115. Medium temperature compressor 125 then sends the compressed refrigerant to high side heat exchanger 105.

Valves 135A-C may be opened or closed to cycle refrigerant from low temperature compressor 130 back to a load (e.g., low temperature load 120A, low temperature load 120B, or medium temperature load 115). The refrigerant may be heated after absorbing heat from other loads and being compressed by low temperature compressor 130. The hot refrigerant and/or hot gas is then cycled over the metallic components of a load to defrost it. Afterwards, the hot gas and/or refrigerant is cycled back to flash tank 110. This process of cycling heated refrigerant over a load to defrost it is referred to as a defrost cycle. In conventional systems, the hot gas travels very quickly over/through the loads. As a result, heat transfer between the hot gas and the load is limited, which causes the hot gas defrost process to use more hot gas to defrost the load.

Cooling system 100 improves heat transfer between the hot gas and the load by increasing the pressure of the hot gas at the load. The system 100 uses a valve 140 (e.g., a regulating valve) that prevents the hot gas at the load from flowing to a receiver (e.g., a flash tank 110) until a pressure of the hot gas at the load exceeds a threshold. By increasing the pressure of the gas at the load, the hot gas lingers longer in the load, which increases the heat transfer between the hot gas and the load. In some instances, the hot gas even condenses at the load. In this manner, less hot gas (i.e., a decreased mass flow of hot gas) is used to defrost a load.

During the defrost cycle, the load that is being defrosted may be turned off. The refrigerant used by the other load(s) supplies the hot gas for the defrost cycle. In the example of FIG. 1, valve 135A controls the flow of hot gas to low temperature load 120B, valve 135B controls the flow of hot gas to low temperature load 120A, and valve 135C controls the flow of hot gas to medium temperature load 115. During a defrost cycle, if low temperature load 120B is being defrosted, then valve 135A is open and valves 135B and 135C are closed. Refrigerant from low temperature load 120A is compressed by low temperature compressor 130 and directed through valve 135A to low temperature load 120B to defrost low temperature load 120B. If low temperature load 120A is being defrosted, then valve 135B is open and valves 135A and 135C are closed. Refrigerant from low temperature load 120B is compressed by low temperature compressor 130 and directed through valve 135B to low temperature load 120A to defrost low temperature load 120A. If medium temperature load 115 is being defrosted, then valve 135C is open and valves 135A and 135B are closed. Refrigerant from low temperature load 120A and/or low temperature load 120B is compressed by low temperature compressor 130 and directed through valve 135C to medium temperature load 115 to defrost medium temperature load 115.

Valve 140 regulates a pressure of the gas at a defrosting load during a hot gas defrost cycle. In certain embodiments, valve 140 is a regulating valve. Generally, valve 140 prevents hot gas from flowing through valve 140 to flash tank 110 unless a pressure of the hot gas exceeds a threshold. Valve 140 may be selected or adjusted to control this threshold. By using valve 140, hot gas that is defrosting a load does not continue flowing through valve 140 to flash tank 110 until a pressure of the gas exceeds the threshold. As a result, heat transfer between hot gas and the load is improved. In some instances, so much heat may be transferred that the hot gas condenses at or in the load, and the refrigerant flowing through valve 140 to flash tank 110 includes a vapor portion and a liquid portion.

Using the previous example, valve 140 prevents hot gas from flowing from a defrosting load to flash tank 110 until a pressure of the hot gas at load exceeds a threshold. As low temperature compressor 130 continues supplying hot gas to the load during the defrost cycle, a pressure of the hot gas at load increases. The hot gas continues to linger at or in the load until the pressure of the hot gas exceeds a threshold controlled by valve 140. As a result, heat transfer between the hot gas and the load is increased. When the pressure of the hot gas exceeds the threshold, the hot gas begins flowing through valve 140 to flash tank 110.

In particular embodiments, when hot gas condenses in the defrosting load during a defrost cycle, flash tank 110 receives the refrigerant as both a vapor and a liquid. Flash tank 110 directs the liquid portion of the refrigerant to other loads, such as low temperature loads 120 and/or medium temperature load 115. These loads then use the refrigerant to cool spaces proximate these loads. Flash tank 110 directs the vapor portion of the refrigerant to medium temperature compressor 125 through valve 145.

Valve 145 controls the flow of vapor refrigerant or flash gas from flash tank 110 to medium temperature compressor 125. In this manner, valve 145 controls an internal pressure of flash tank 110. By opening valve 145 more, an internal pressure of flash tank 110 may decrease. By closing valve 145, an internal pressure of flash tank 110 may increase. Valve 145 may be referred to as a flash gas bypass valve.

FIG. 2 illustrates an example cooling system 200. As seen in FIG. 2, system 200 includes high side heat exchanger 105, flash tank 110, medium temperature load 115, low temperature loads 120A and 120B, medium temperature compressor 125, low temperature compressor 130, valves 135A-C, and valve 145. Similar to system 100, system 200 prevents a hot gas from flowing to flash tank 110 during a defrost cycle until a pressure of the hot gas exceeds a threshold. In this manner, heat transfer between the hot gas and a low temperature load 120 is increased.

Generally, high side heat exchanger 105, flash tank 110, medium temperature load 115, low temperature loads 120A and 120B, medium temperature compressor 125, low temperature compressor 130, and valve 135 function similarly as they did in system 100. For example, high side heat exchanger 105 removes heat from a refrigerant. Flash tank 110 stores the refrigerant. Medium temperature load 115 and low temperature loads 120A and 120B use the refrigerant to cool spaces proximate those loads. Low temperature compressor 130 compresses refrigerant from low temperature loads 120A and 120B. Medium temperature compressor 125 compresses refrigerant from medium temperature load 115 and low temperature compressor 130. Valves 135A-C open and close to control the flow of hot gas to the loads. During the defrost cycle, low temperature compressor 130 directs refrigerant through a valve 135A-C to a load to defrost the load.

An important difference between system 200 and system 100 is the use of valve 145 and the absence of valve 140. In system 200, instead of using valve 140 to control the flow of hot gas from a load to flash tank 110 during the defrost cycle, valve 145 is used to control an internal pressure of flash tank 110. The internal pressure of flash tank 110 then prevents hot gas from flowing from the defrosting load to flash tank 110 until a pressure of the hot gas is greater than the internal pressure of flash tank 110. In this manner, system 200 achieves the same result as system 100 without using valve 140, which makes system 200 cost less than system 100 in certain instances. As in system 100, valve 145 controls the internal pressure of flash tank 110 by allowing a certain amount of flash gas and/or vapor refrigerant to flow from flash tank 110 to medium temperature 125.

FIG. 300 is a flow chart illustrating a method 300 of operating an example cooling system. In particular embodiments, certain portions of system 100 and/or system 200 perform the steps of method 300. By performing method 300, the heat transfer between a hot gas and a low temperature load is increased during a defrost cycle.

In step 305, a high side heat exchanger removes heat from a refrigerant. A flash tank stores the refrigerant in step 310. In step 315, it is determined whether the system is in a first mode of operation such as, for example, a regular refrigeration mode. If the system is in the regular refrigeration mode, then a load such as a medium temperature load uses the refrigerant to cool a first space in step 320. In step 325, a second load, such as a low temperature load, uses the refrigerant to cool a second space. A third load, such as another low temperature load, uses the refrigerant to cool a third space in step 330. In step 335, a low temperature compressor compresses the refrigerant from the two low temperature loads. In step 340, a medium temperature compressor compresses the refrigerant from the medium temperature load and the low temperature compressor.

If it is determined in step 315 that the system is not in a regular refrigeration cycle and instead is in a second mode of operation such as, for example, a defrost cycle, then the system proceeds to use hot gas to defrost a low temperature load. In step 345, the medium temperature load uses the refrigerant to cool the first space. In step 350, a low temperature load uses the refrigerant to cool the second space. The low temperature compressor compresses the refrigerant from the low temperature load in step 355. The medium temperature compressor compresses the refrigerant from the medium temperature load in step 360. In step 365, the low temperature compressor directs the refrigerant to a third load, such as the low temperature load, to defrost the low temperature load. In step 370, a valve prevents the refrigerant at the third load from flowing to the flash tank until a pressure the refrigerant at the third load exceeds a threshold. In some embodiments, the valve is a regulating valve between the low temperature load being defrosted and the flash tank. In other embodiments, the valve is a flash gas bypass valve positioned between the flash tank and the medium temperature compressor.

Modifications, additions, or omissions may be made to method 300 depicted in FIG. 3. Method 300 may include more, fewer, or other steps. For example, steps may be performed in parallel or in any suitable order. While discussed as systems 100 and/or 200 (or components thereof) performing the steps, any suitable component of systems 100 and/or 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a flash tank configured to store the refrigerant;

a first load configured to use the refrigerant from the flash tank to cool a first space proximate the first load;

a second load;

a third load;

a first compressor; and a second compressor;

during a first mode of operation:

the second load is configured to use the refrigerant from the flash tank to cool a second space proximate the second load;

the third load is configured to use the refrigerant from the flash tank to cool a third space proximate the third load;

the second compressor is configured to compress the refrigerant from the second load and the third load; and the first compressor is configured to compress the refrigerant from the first load and the second compressor, and during a second mode of operation:

the second compressor is configured to compress the refrigerant from the second load and to direct the compressed refrigerant to the third load to defrost the third load.

2. The apparatus of claim 1, wherein, during the second mode of operation, the refrigerant at the third load condenses.

3. The apparatus of claim 2, wherein, during the second mode of operation, the flash tank is further configured to direct a liquid portion of the refrigerant from the third load to at least one of the first load and the second load.

4. The apparatus of claim 2, wherein, during the second mode of operation, the flash tank is further configured to direct a vapor portion of the refrigerant from the third load to the first compressor.

5. The apparatus of claim 1, further comprising a valve configured to direct a flash gas from the flash tank to the first compressor.

6. The apparatus of claim 5, wherein, during the second mode of operation, the refrigerant from the third load is directed through the valve before the refrigerant reaches the flash tank.

7. The apparatus of claim 1, wherein, during the second mode of operation, the second load is further configured to use the refrigerant from the flash tank to cool the second space.

8. A method comprising:

removing, by a high side heat exchanger, heat from a refrigerant;

storing, by a flash tank, the refrigerant;

using, by a first load, the refrigerant from the flash tank to cool a first space proximate the first load;

during a first mode of operation:

using, by a second load, refrigerant from the flash tank to cool a second space proximate the second load;

using, by a third load, the refrigerant from the flash tank to cool a third space proximate the third load;

compressing, by a second compressor, the refrigerant from the second load and the third load; and compressing, by a first compressor, the refrigerant from the first load and the second compressor, and during a second mode of operation:

compressing, by the second compressor, the refrigerant from the second load; and directing, by the second compressor, the compressed refrigerant to the third load to defrost the third load.

9. The method of claim 8, wherein, during the second mode of operation, the refrigerant at the third load condenses.

10. The method of claim 9, further comprising, during the second mode of operation, directing, by the flash tank, a liquid portion of the refrigerant from the third load to at least one of the first load and the second load.

11. The method of claim 9, further comprising, during the second mode of operation, directing, by the flash tank, a vapor portion of the refrigerant from the third load to the first compressor.

12. The method of claim 8, further comprising directing, by a valve, a flash gas from the flash tank to the first compressor.

13. The method of claim 12, wherein, during the second mode of operation, the refrigerant from the third load is directed through the valve before the refrigerant reaches the flash tank.

14. The method of claim 8, further comprising, during the second mode of operation, using, by the second load, the refrigerant from the flash tank to cool the second space.

15. A system comprising:

a flash tank configured to store a refrigerant;

a first load configured to use the refrigerant from the flash tank to cool a first space proximate the first load;

a second load;

a third load;

a first compressor; and a second compressor;

during a first mode of operation:

the second load is configured to use the refrigerant from the flash tank to cool a second space proximate the second load;

the third load is configured to use the refrigerant from the flash tank to cool a third space proximate the third load;

the second compressor configured to compress the refrigerant from the second load and the third load; and the first compressor configured to compress the refrigerant from the first load and the second compressor, and during a second mode of operation:

the second compressor configured to compress the refrigerant from the second load and to direct the compressed refrigerant to the third load to defrost the third load.

16. The system of claim 15, wherein, during the second mode of operation, the refrigerant at the third load condenses.

17. The system of claim 16, wherein, during the second mode of operation, the flash tank is further configured to direct a liquid portion of the refrigerant from the third load to at least one of the first load and the second load.

18. The system of claim 16, wherein, during the second mode of operation, the flash tank is further configured to direct a vapor portion of the refrigerant from the third load to the first compressor.

19. The system of claim 15, further comprising a valve configured to direct a flash gas from the flash tank to the first compressor.

20. The system of claim 19, wherein, during the second mode of operation, the refrigerant from the third load is directed through the valve before the refrigerant reaches the flash tank.

* * * * *